US006736199B2

(12) United States Patent
Wanni et al.

(10) Patent No.: US 6,736,199 B2
(45) Date of Patent: May 18, 2004

(54) HEAT EXCHANGER WITH FLOATING HEAD

(75) Inventors: Amar S. Wanni, Falls Church, VA (US); Marciano M. Calanog, Gainesville, VA (US); Thomas M. Rudy, Warrenton, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/414,731

(22) Filed: Apr. 16, 2003

(65) Prior Publication Data

US 2003/0196781 A1 Oct. 23, 2003

Related U.S. Application Data

(60) Provisional application No. 60/374,663, filed on Apr. 23, 2002.

(51) Int. Cl.[7] ..... F28F 9/02; F28F 7/00; F28F 9/22

(52) U.S. Cl. ..... 165/158; 165/82; 165/145; 165/173; 165/175

(58) Field of Search ..... 165/82, 81, 83, 165/149, 143, 144, 145, 158, 173, 175, 134.1

(56) References Cited

U.S. PATENT DOCUMENTS

| | | | | |
|---|---|---|---|---|
| 1,777,356 A | | 10/1930 | Fisher | |
| 1,946,234 A | | 2/1934 | Price | |
| 1,978,166 A | * | 10/1934 | Meurk | 165/134.1 |

(List continued on next page.)

FOREIGN PATENT DOCUMENTS

| | | |
|---|---|---|
| DE | 890349 | 9/1953 |
| DE | 928716 | 6/1955 |
| DE | 1261136 | 2/1968 |
| FR | 2059139 | 5/1971 |
| FR | 2380700 | 9/1978 |
| GB | 607717 | 9/1948 |
| GB | 620292 | 3/1949 |
| GB | 644651 | 10/1950 |
| GB | 796923 | 6/1958 |
| JP | 58184498 | 10/1983 |
| WO | WO 00/65286 | 11/2000 |

OTHER PUBLICATIONS

English translation (uncertified and Applicant cannot attest to its accuracy) of FR 2,059,139.
English translation (uncertified and Applicant cannot attest to its accuracy) of FR 2,380,700.
English Abstract of JP58184498.
Application Ser. No. 10/209,126, filed Jul. 31, 2002.
Application Ser. No. 10/209,082, filed Jul. 31, 2002.

*Primary Examiner*—Henry Bennett
*Assistant Examiner*—Tho V Duong
(74) *Attorney, Agent, or Firm*—Malcolm D. Keen

(57) ABSTRACT

A heat exchanger in which dead zones and areas of stagnation are significantly minimized or eliminated. The heat exchanger includes at least one floating tubesheet which is movable in a longitudinal direction in response to tube expansion and contraction relative to the heat exchanger shell. The shell is joined to the ends by conical members which preferably join onto the shell at a distance along its length to provide shell extensions which promote better flow patterns in the regions of the tube ends. Tube erosion may be addressed by providing a sacrificial portion of tube length extending beyond the tube sheets so as to make repair and replacement of the eroded portion of tubes significantly cheaper, easier and with minimal process interruption. Because axial or longitudinal flow is employed with respect to the shell-side fluid, tube vibration problems are generally eliminated and fouling is minimized through the use of high fluid velocities. Multiple heat exchangers may be combined in a modular fashion by placing individual exchangers either in series, in parallel or both in order to satisfy various process requirements.

20 Claims, 6 Drawing Sheets

U.S. PATENT DOCUMENTS

| | | | | | |
|---|---|---|---|---|---|
| 2,610,832 | A | | 9/1952 | Holmes et al. | |
| 2,774,575 | A | | 12/1956 | Walter | |
| 3,326,282 | A | | 6/1967 | Jenssen | |
| 3,603,383 | A | | 9/1971 | Michael et al. | |
| 3,656,543 | A | * | 4/1972 | Wolowodiuk et al. | 165/74 |
| 3,822,741 | A | * | 7/1974 | Lippitsch | 165/83 |
| 4,097,544 | A | * | 6/1978 | Hengstebeck | 585/634 |
| 4,368,694 | A | * | 1/1983 | Ward et al. | 122/504 |
| 4,386,456 | A | | 6/1983 | Volz | |
| 4,450,904 | A | | 5/1984 | Volz | |
| 4,858,681 | A | * | 8/1989 | Sulzberger | 165/70 |
| 4,858,684 | A | * | 8/1989 | Brucher et al. | 165/134.1 |
| 6,206,086 | B1 | * | 3/2001 | McKey | 165/76 |

* cited by examiner

HEAT EXCHANGER WITH FLOATING HEAD

CROSS REFERENCE TO RELATED APPLICATIONS

This application is a complete application on Provisional Application No. 60/374,663, filed Apr. 23, 2002, from which priority is claimed.

Related applications include co-pending U.S. application Ser. No. 10/209,126 (Provisional No. 60/366,914) entitled "Heat Exchanger Flow Through Tube Supports" and co-pending U.S. application Ser. No. 10/209,082 (Provisional No. 60/366,776) entitled "Improved Heat Exchanger with Reduced Fouling".

FIELD OF THE INVENTION

The present invention relates to heat exchangers.

BACKGROUND OF THE INVENTION

Although heat exchangers were developed many decades ago, they continue to be extremely useful in many applications requiring heat transfer. While many improvements to the basic design of heat exchangers have been made over the course of the twentieth century, there still exist tradeoffs and design problems associated with the inclusion of heat exchangers within commercial processes.

One of the most problematic aspects associated with the use of heat exchangers is the tendency toward fouling. Fouling refers to the various deposits and coatings which form on the surfaces of heat exchangers as a result of process fluid flow and heat transfer. There are various types of fouling including corrosion, mineral deposits, polymerization, crystallization, coking, sedimentation and biological. In the case of corrosion, the surfaces of the heat exchanger can become corroded as a result of the interaction between the process fluids and the materials used in the construction of the heat exchanger. The situation is made even worse due to the fact that various fouling types can interact with each other to cause even more fouling. Fouling can and does result in additional resistance with respect to the heat transfer and thus decreased performance with respect to heat transfer. Fouling also causes an increased pressure drop in connection with the fluid flowing on the inside of the exchanger.

One type of heat exchanger which is commonly used in connection with commercial processes is the shell-and-tube exchanger. In exchangers of this type, one fluid flows on the inside of the tubes, while the other fluid is forced through the shell and over the outside of the tubes. Typically, baffles are placed to support the tubes and to force the fluid across the tube bundle in a serpentine fashion.

Fouling can be decreased through the use of higher fluid velocities. In fact, one study has shown that a reduction in fouling in excess of 50% can result from a doubling of fluid velocity. The use of higher fluid velocities can substantially decrease or even eliminate the fouling problem. Unfortunately, sufficiently high fluid velocities needed to substantially decrease fouling are generally unattainable on the shell-side of conventional shell-and-tube heat exchangers because of excessive pressure drops which are created within the system because of the baffles. Also, when shell-side fluid flow is in a direction other than in the axial direction and especially when flow is at high velocity, flow-induced tube vibration can become a substantial problem in that various degrees of tube damage may result from the vibration.

Existing shell-and-tube heat exchangers suffer from the fact that "dead zones" and areas of fluid stagnation exist on the shell-side of the exchanger. These dead zones and areas of stagnation generally lead to excessive fouling as well as reduced heat-transfer performance. One particular area of fluid stagnation which exists in conventional shell-and-tube heat exchangers is the area near the tubesheet near the outlet nozzle for the shell-side fluid to exit the heat exchanger. Because of known fluid dynamic behavior, a dead zone or stagnant region tends to form, located in the region between the tubesheet and each nozzle. This area of restricted fluid flow on the shell-side can cause a significant fouling problem in the area of the tubesheet because of the nonexistent or very low fluid velocities in this region. The same problem as described above also exists within the region adjacent to the inlet nozzle.

The fluid flow may be at low velocities in particular areas within the heat exchanger such as in the areas between the entry nozzle and the tubesheet and the exit nozzle and the tubesheet. Various solutions to this problem have been provided in co-pending patent application entitled "Improved Heat Exchanger with Reduced Fouling", U.S. patent application Ser. No. 10/209,082 (U.S. Provisional No. 60/366,776). The solutions provided include the inclusion of a shell extension, a conical connection between the shell and the tubesheet and a conical tubesheet extension; these structural elements may be combined as necessary or as desired in order to address fouling problems.

The above described solutions work well in a great majority of cases but in some applications, particularly where the temperature difference between the shell-side fluid and the tube-side fluid is great, excessive differential thermal expansion of the tubes relative to the shell in the lengthwise direction can occur. Significant structural damage can occur as a result of this tube expansion if the tubesheets are welded to the heat exchanger shell.

Yet another drawback of most prior art heat exchangers is their limited flexibility in terms of the overall process design. For example, in most applications it is desirable for shell-side flow velocity to be the same as or roughly equivalent to the tube-side flow velocity. However, given process flow rate constraints it is often difficult if not impossible to achieve a similarity between shell-side and tube-side flow velocities. This is due to the fixed design of heat exchangers in that there are predetermined cross-sections through which fluid may flow resulting in constrained flow velocities within the heat exchanger given predetermined process flow rates into the heat exchanger.

SUMMARY OF THE INVENTION

The present invention comprises a novel heat exchanger configuration which preferably uses the axial flow direction for the shell-side fluid and in which dead zones and areas of stagnation are significantly minimized or eliminated. The heat exchanger of the present invention has the tube in the tube bundle extending between a fixed tubesheet at one end of the exchanger and a floating tubesheet which is preferably located in the return head. The floating tubesheet preferably has a conical shaped extension so that tube surface area exposure in regions of low flow velocities is minimized; a similar conical extension may also be provided on the fixed tubesheet. In one particular embodiment, the heat exchanger includes a central pipe which serves to transport tube-side fluid either from the header to the other end of the heat exchanger or from the end where the return end is located back to the header. The tubesheets and tube bundle can be made so as to be easily removable from the shell for cleaning, inspection and/or maintenance purposes.

The heat exchanger components may be configured in modular assemblies. A significant amount of design flexibility may be obtained by using "off the shelf" standardized heat exchangers placed in parallel and/or in series with respect to either or both of the shell-side flow and the tube-side flow. The standard size "off-the-shelf" heat exchanger modules are employed to maximize the benefits of the fouling reducing aspects of the present invention and to allow for very significant reductions in design time when preparing to implement processes. Several smaller standard size heat exchangers may be employed in parallel or in series or in both parallel and series to achieve the desired process characteristics including meeting the necessary heat-transfer requirements.

The present invention provides advantages including a significant reduction of dead zones and low-fluid-velocity regions which would otherwise lead to significant fouling problems. The heat exchangers also provide other significant advantages such as permitting the removal of the tube bundle for easy and more effective cleaning, inspection and/or maintenance. They also allow for the avoidance of problems associated with differential thermal expansion of tubes relative to the shell in applications where the difference between tube-side and shell-side fluid temperatures is relatively large.

THE DRAWINGS

DETAILED DESCRIPTION

Figure 1:
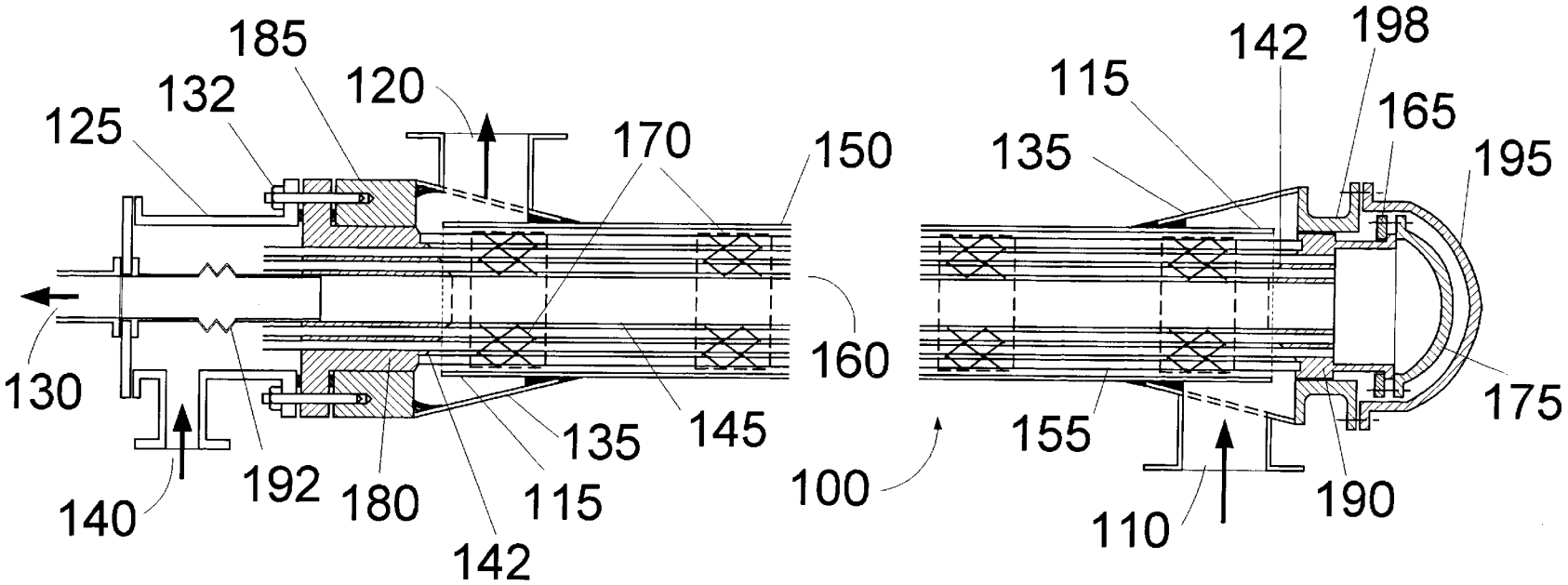
FIG. 1 is a side elevation cutaway view of a heat exchanger having a removable tube bundle and a central pipe representing a first embodiment of the present invention.

FIG. 1 illustrates a heat exchanger 100 constructed according to the present invention. In the figure, the shell portion is broken away to illustrate the tube bundle construction more clearly. While FIG. 1 shows a shell-and-tube exchanger, the present invention is equally applicable to many other forms of shell-and-tube exchangers. The heat exchanger 100 illustrated in FIG. 1 is a two-pass heat exchanger with a large central tube positioned to transport tube-side fluid during the second pass from the return head located near the end of the heat exchanger 100 near shell-side inlet nozzle 110 to the other end of the heat exchanger 100 where the tube-side fluid exits the heat exchanger 100 at tube-side outlet 130. Although the embodiment of the heat exchanger 100 is described as a two-pass heat exchanger, in reality, an overwhelmingly large percentage of overall heat transfer occurs during the first pass with only very limited heat transfer occurring during the second pass while the tube-side fluid is flowing through central pipe 145 toward tube-side outlet nozzle 130.

The heat exchanger 100 includes a shell 150 and a tube bundle 160 contained in it. Tube bundle 160 includes tubesheets 180 and 190 located, respectively, at each end of the tube bundle 160. Tubesheet 180 is fixed in place while tubesheet 190 is movable with respect to the longitudinal axis of the exchanger part, forming part of a floating head, described in greater detail below. The tubes contained in tube bundle 160 are fastened to apertures within tubesheets 180 and 190 by known means in the art such as by welding or by expanding the tubes into the tubesheets. Tube-side inlet 140 and tube-side outlet 130 allow for introducing a first fluid into the tubes in tube bundle 160, and for expelling the first fluid from exchanger 100, respectively. Shell-side inlet 110 and shell-side outlet 120 allow for a second fluid to enter and exit the shell-side of heat exchanger 100, respectively, and thus pass over the outside of the tubes comprising tube bundle 160.

The embodiment shown in FIG. 1 includes tube supports 170. Tube supports 170 are preferably metal coil structures disclosed in co-pending patent application entitled "Heat Exchanger Flow Through Tube Supports", corresponding to U.S. application Ser. No. 10/209,126 (Provisional No. 60/366,914) and which eliminates the need for baffles and allows for high-velocity fluid flow. By using these metal coil structures as tube supports 170, conventional baffles may be eliminated and higher fluid velocities may be employed. Alternatively, the tubes in tube bundle 160 may consist of "twisted tubes" or may be supported by conventional means such as by "rod baffles" or "egg crate" style tube supports. Segmental baffles are not preferred because they generally do not allow high-velocity fluid flow and they further create dead zones.

Preferably, axial flow is used for the shell-side fluid. The heat exchanger permits countercurrent flow as between the shell-side and the tube-side fluids during the first pass in which the majority of heat transfer takes place and although countercurrent flow is preferable for the first pass in most cases, co-current flow may be employed by introducing shell-side fluid at outlet 120 and permitting shell-side fluid to exit at inlet 110.

In FIG. 1, the tubes in tube bundle 160 extend some length beyond the surface of the fixed tubesheet 180 in the direction of and towards tube-side inlet 140. Preferably, the extension is at least 15 cm (6 inches) beyond the surface of tubesheet 180 and possibly more depending upon the intended fluid velocities and the tube metallurgy. The extended tube length serves as a sacrificial length which may be easily replaced when necessary or desirable so as to avoid the effects of inlet tube erosion which is more prevalent at higher fluid velocities. The more rapid the intended fluid velocities, the longer the tube length extension should be. The only practical limitation on the tube length extension is the requirement that the tube length not extend so much such that unfavorable velocity profiles are created within header 125 or failure occurs due to tube vibration.

Typically, the tube length extension is 15 cm. (6 inches) beyond the surface of tubesheet 180. This length of extension is satisfactory for tube materials such as carbon steel, copper nickel and other metals or other materials which are subject to erosion at levels that can cause perforation problems. In the case of brass or other tube materials which are especially susceptible to erosion, tube lengths may be preferably extended beyond 15 cm. (6 inches). Varying extension lengths may of course be used: the extension length should increase as the susceptibility to erosion of the tube material increases.

The use of extended tube lengths allows for periodic replacement of the sacrificial tube section as erosion occurs or at selected time intervals. The sacrificial section may be cut off and a new sacrificial section may be welded on or otherwise fastened by expanding a new section within the remaining portion of the tube length which extends outward from the tubesheet. Welding and other techniques may also be employed in order to replace sacrificial tube lengths as may be required.

Dead zones and low-flow areas are reduced or even eliminated by the illustrated configuration, to allow consistent high-velocity fluid flow throughout the heat exchanger 100. Shell extensions 115 are included to extend shell 150 past the points (axially) at which shell 150 meets cones 135 at both ends of the shell. Cone 135 at the fixed tubesheet end of the exchanger extends from shell 150 to front end girth ring 185 which surrounds a portion of fixed tubesheet 180 and is attached to it by means of fasteners 132 which preclude axial movement of tubesheet 180 relative to the shell 150. At the other end of the shell and the tube bundle, cone 135 extends from shell 150 to floating end girth ring 198 which surrounds the outer periphery of movable tubesheet 190. Tubesheet 190 is free to slide axially within girth ring 198 to allow for axial thermal expansion of tube bundle 160. Cone 135 may be provided at either or both of the ends of shell 150. By extending the shell 150 through the use of shell extensions 115, shell-side fluid flow in the vicinity of tubesheets 180 and 190 is improved in that the fluid does not have an opportunity to immediately enter or leave the region immediately adjacent to the inlet and outlets 110 and 120, respectively, where fluid velocity would otherwise be slowed significantly. Further, shell extensions 115 minimize shell-side tube erosion problems because they prevent shell-side fluid from directly flowing against tube bundle 160 upon entry or upon exiting from heat exchanger 100.

Floating tubesheet 190 is not fixed in location with respect to shell 150 and can therefore move longitudinally in the direction towards and away from shell cover 195. This allows for expansion and contraction of tubes in tube bundle 160 depending upon the relative temperatures of the shell-side fluid and the tube-side fluid. In addition, tube bundle 160 and tubesheets 180 and 190 are easily removable from shell 150 so that cleaning and other tube bundle and tubesheet maintenance may be easily performed. This is made possible by fastener 132 (on the fixed tubesheet side) and split ring 165 (on the floating head side, details in FIG. 2) which allow header 125 and shell cover 195, respectively, to be removed from shell so that the tube bundle 160 may also be removed. Additional features of heat exchanger 100 as shown in FIG. 1 are also present in the embodiment illustrated in FIG. 3.

The size and shape of cone 135 is selected based upon fluid modeling studies but in most cases standard parts which are readily available may be selected for use as cone 135. Cone 135, together with shell extension 115, serves to direct fluid flow towards tubesheets 180 and 190 rather than permitting fluid to immediately exit outlet nozzle 170 or to immediately enter the interior of tube bundle 160 from inlet nozzle 110, as applicable. By doing so, the low-velocity fluid zones which would otherwise exist in the vicinity of tubesheets 180 and 190 are eliminated.

Figure 2:
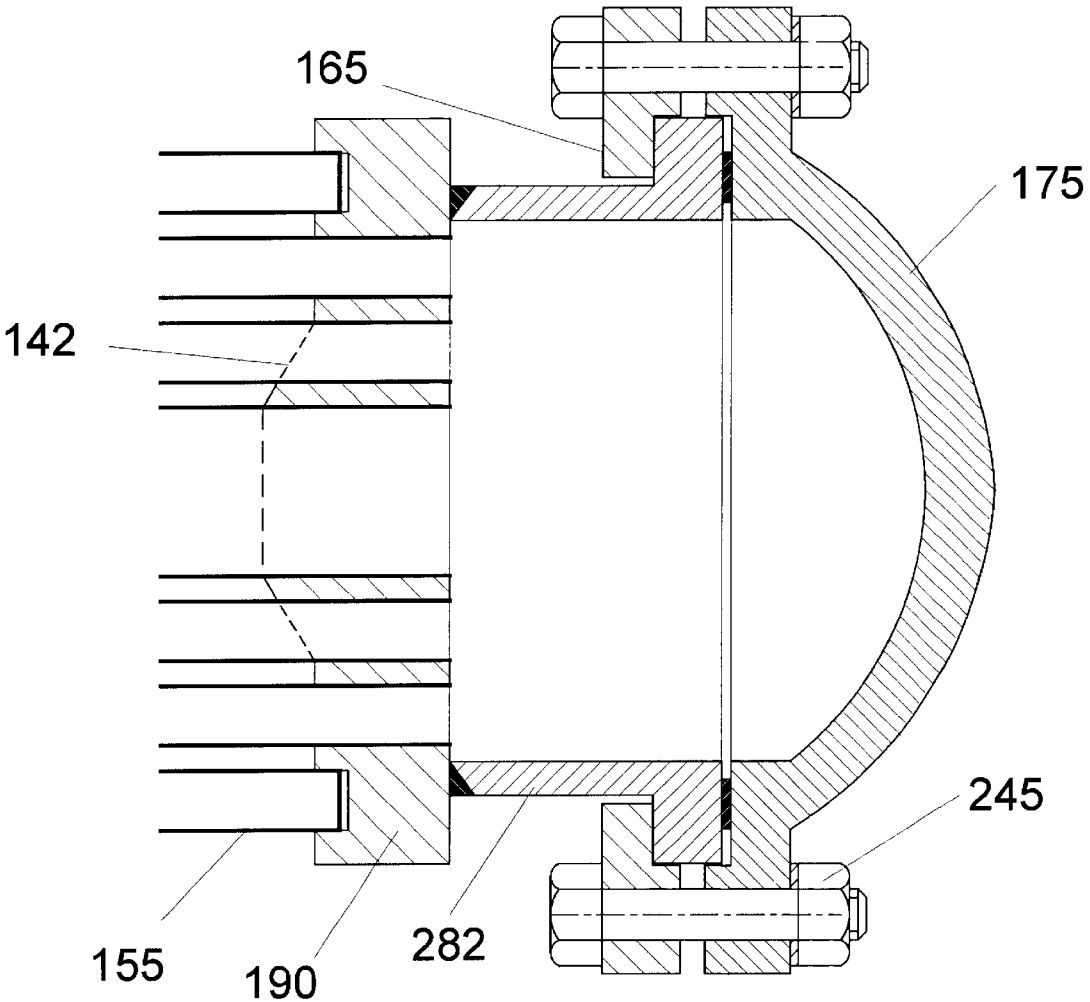
FIG. 2 is a more detailed view of the floating head area of the heat exchanger illustrated in FIG. 1.
Figure 3:
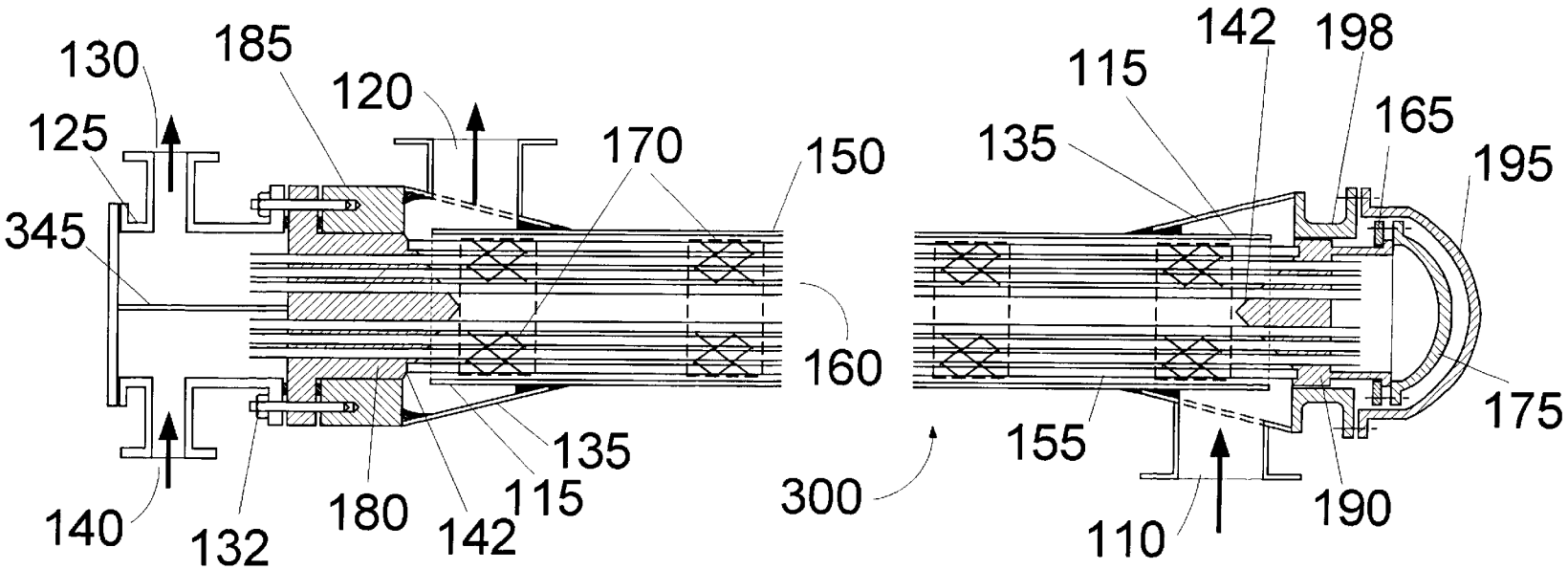
FIG. 3 is a side elevation cutaway view of a two-pass heat exchanger according to a second embodiment of the present invention.
Figure 4:
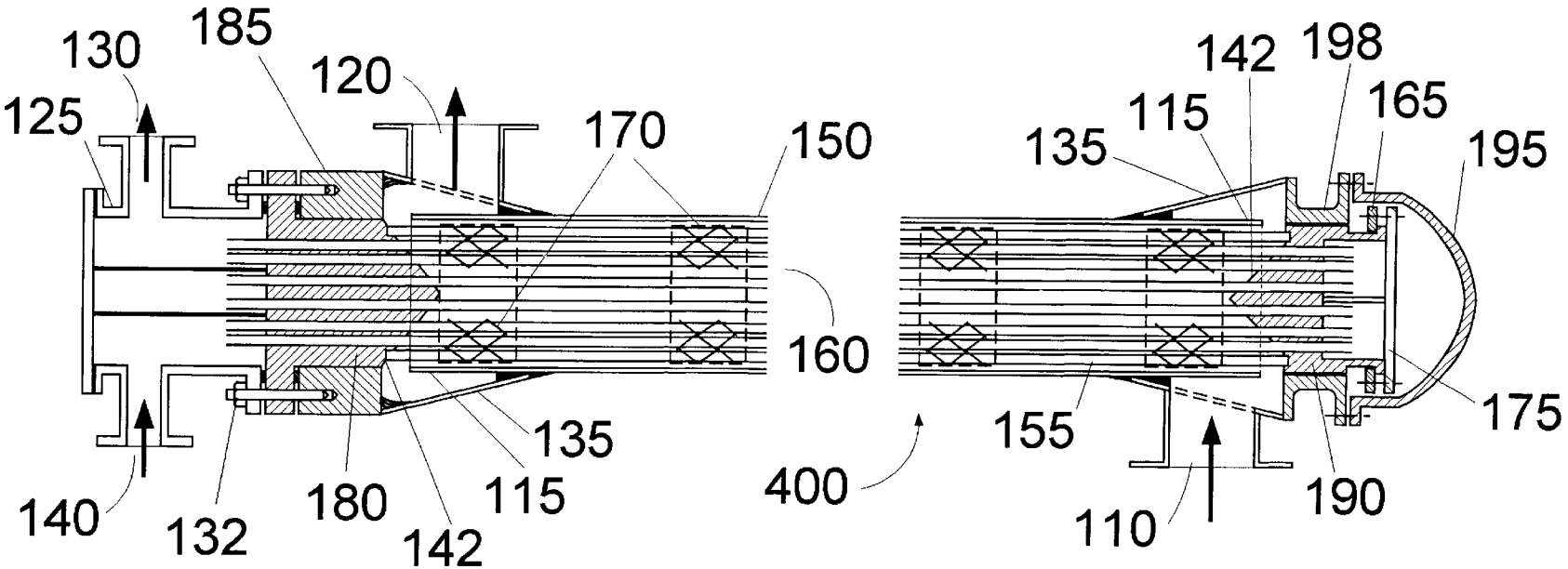
FIG. 4 is a side elevation cutaway view of a four-pass heat exchanger according to a third embodiment of the present invention.
Figure 5:
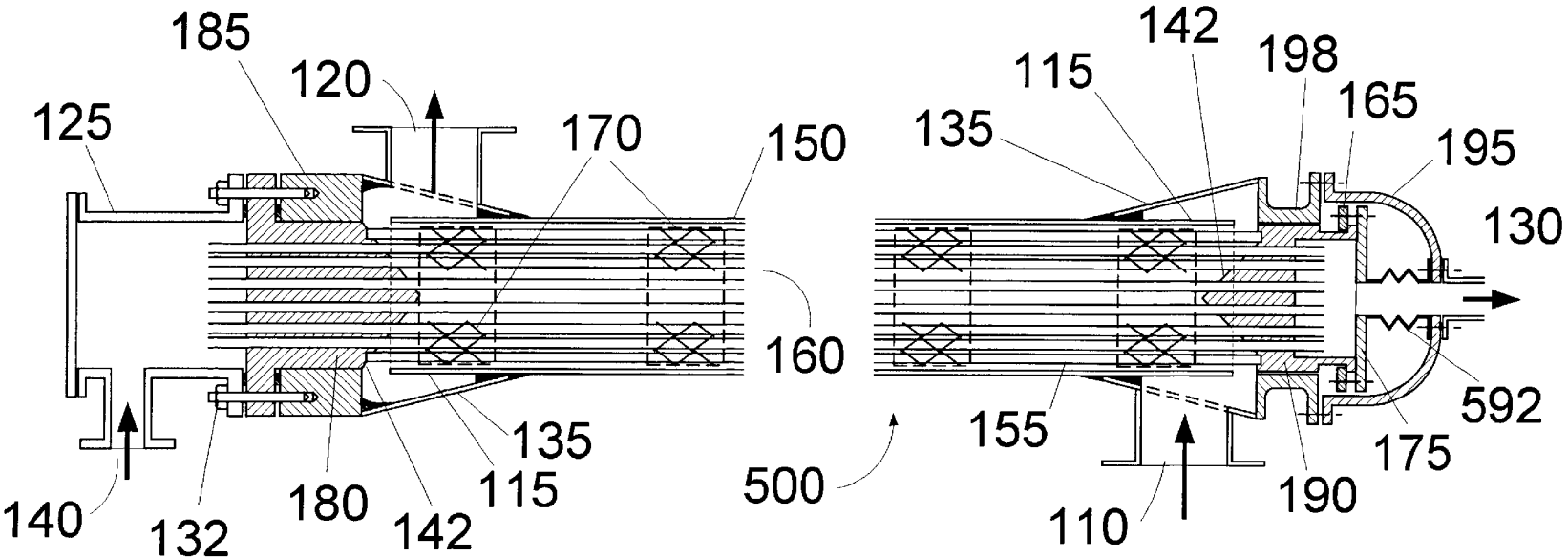
FIG. 5 is a side elevation cutaway view of a single-pass heat exchanger with a tube-side expansion joint according to a fourth embodiment of the present invention.

Tubesheets 180 and 190 each include a conical shaped extension 142 which protrudes toward the interior of the heat exchanger cavity and away from inlet 140 and outlet 130 respectively (shown more readily in FIG. 2, see also FIG. 5). The extension or protrusion is in the form of a cone frustum in FIGS. 1 and 2 and a completely conical extension as shown in FIGS. 3, 4 and 5. References to the extension as conical therefore include completely conical extensions, cone frusta as well as extensions of other forms which reduce or eliminate the dead or low flow regions, for example, extensions which are spheroidal or of other curved configurations although these will normally be less preferred as they are not so easy to fabricate. Here, the complete diameters of tubesheets 180 and 190 form the base for the frusto-conical protrusions extending from the surface of the tubesheets. Alternatively, only a portion of the diameter of tubesheets 180 and 190 may form the base for the conical protrusions. For example, according to this embodiment, the conical protrusion may be formed to have a base diameter of 10–15 cm. (4–6 inches) while the diameter of the tubesheets 180 or 190 may be on the order of 30–60 cm. (12–24 inches). It is preferable in this case for the center points of the conical protrusion to be the same as the center points of the tubesheets themselves. In other words, the conical protrusions are preferably centered on the circular surfaces of the tubesheets 180 and 190.

The inclusion of the conical protrusions results in the reduction and/or elimination of a small dead zone and low-flow area which would otherwise tend to be present in the present heat exchanger adjacent to the center of the interior tubesheet surface facing the heat exchanger cavity. The particular low-flow area which otherwise would be present in the heat exchanger results from the inclusion of the shell extensions 170 and cone 135 components of the present invention. By including the tubesheet protrusions, the spaces in heat exchanger 100 which are taken up by the protrusions which would otherwise be "dead zones" or low-flow areas are filled up with solid material so that the low-flow areas and "dead zones" are eliminated with negligible or no loss of heat-transfer capability.

The sizing and detailed shape of the conical protrusions may vary from the examples provided above. Fluid modeling methodologies as are known in the art may be employed if desired to determine the particular sizes and shapes that meet the desired criteria for the specific design. Of course, the conical protrusion on one tubesheet need not be the same in terms of size or shape as another conical protrusion on another tubesheet within a particular heat exchanger. Sizing and shaping between and among protrusions on tubesheet surfaces may vary according to expected specific fluid flow velocities and tendencies.

Heat exchanger 100 also includes central pipe 145 which transports tube-side fluid from floating tubesheet 190 towards the other side of heat exchanger 100 such that tube-side fluid may exit heat exchanger 100 at tube-side outlet nozzle 130. Central pipe 145 preferably includes a longitudinally expandable section 192 in the region of central pipe 145 which is contained within header 125. This expandable region is preferably constructed of the same material as the tube and is available from specialized manufacturers. The design of heat exchanger 100 to include central pipe 145 permits tube-side inlet 140 and tube-side outlet 130 to be located on the same side of heat exchanger 100.

FIG. 2 provides a more detailed view of the region near floating tubesheet 190. Shell cover 195 is not shown in FIG. 2 but floating tubesheet 190 and in particular floating head cover 175 may move longitudinally in the direction toward shell cover 195 with movement being limited only to the point when floating head cover 175 comes in physical contact with shell cover 195. The spacing is preferably arranged so that floating tubesheet 190 can move approximately 2.5 to 5 cm. (1 to 2 inches) although additional or less spacing may be used as required by the particular application.

Floating head cover 175 is preferably removable from the remaining portion of floating tubesheet 190 through the use of split ring 165 which is provided and, for example, bolts with associated nuts 245 or other fastening mechanism. Also, as can be seen in FIG. 2, rods or tubes 155 are preferably incorporated in the design such that they terminate within floating tubesheet 190 and provide additional support. Connector element 282 is also preferably included in order to allow floating tubesheet 190 to be connected to floating head cover 175. Connector element 282 may be welded to floating tubesheet 190 or floating tubesheet may be initially formed to include connector element 282.

FIG. 3 shows another heat exchanger configuration. Heat exchanger 300 illustrated in FIG. 3 is a two-pass configuration in which tube-side fluid enters through inlet 140 and moves through tubes to the other end of heat exchanger 300 into the floating return head. Tube-side fluid then travels in the opposite direction for a second pass after which tube-side fluid exits heat exchanger 300 through outlet 130. In the configuration shown in FIG. 3, the first pass provides countercurrent flow with respect to shell-side fluid while the second pass results in co-current flow with respect to the shell-side fluid. If shell-side inlet 110 and shell-side outlet 120 were reversed, countercurrent flow may be obtained in the second pass with co-current flow during the first pass. Heat exchanger 300 includes pass partition plate 345 so as to ensure that entering tube-side fluid flows through the tubes rather than immediately exiting heat exchanger 300 through outlet 130. In addition, as with the configuration of heat exchanger 100 in FIG. 1, the configuration of heat exchanger 300 is such that header 125, tubesheet 180 and tube bundle 160 are easily removed from the heat exchanger shell body through the use of fasteners such as nutted stud 132. Further, on the other end of heat exchanger 300, floating tubesheet 190, floating return head cover 175, shell cover 195 and the tubes in tube bundle 160 may also be removed from shell 150 using split ring 165 to remove return head cover 175.

As is the case with the exchanger of FIG. 1, it is preferable for the tubes in tube bundle 260 to be supported by the coil structure which is disclosed in the co-pending patent application entitled "Heat Exchanger Flow Through Tube Supports" referred to above so that baffles may be eliminated and so that high-velocity fluid flow may be achieved. Alternatively, the tubes in tube bundle 160 may consist of twisted tubes or may be supported by conventional means such as by rod baffles or egg crate style tube supports. Again, segmental baffles are not preferred in this embodiment because they generally do not allow high-velocity fluid flow and they further create dead zones.

The tubes in tube bundle 160 of FIG. 3 extend some length beyond the surface of tubesheet 180 in the direction of and towards tube-side inlet 140 and tube-side outlet 130. In the FIG. 3 embodiment, the extension is at least 15 cm. (6 inches) beyond the surface of tubesheet 180 and possibly more depending upon the intended fluid velocities and the tube metallurgy. Varying extension lengths may be used in the FIG. 3 embodiment: the extension length should increase as the tube material's susceptibility to erosion increases.

Consistent high-velocity fluid flow through heat exchanger 300 is provided, as in FIG. 1 by the use of shell extensions. A first shell extension 115 (on the left side of FIG. 3) extends shell 150 laterally past the point at which the shell 150 meets cone 135 extending from girth ring 185 around the outer periphery of tubesheet 180. A second shell extension 115 (on the right side of FIG. 3) extends shell 150 laterally past the point at which shell 150 meets cone 135. Cone 135 extends from shell 150 to girth ring 198 which surrounds movable tubesheet 190 and to which return head cover is fastened. By extending shell 150 through the use of shell extensions 115 as indicated in FIG. 3, shell-side fluid flow is directed towards the tubesheet 180 and floating head cover 175, respectively, without the fluid having the opportunity to immediately enter the region immediately adjacent to shell-side inlet nozzle 110 and outlet nozzle 120, respectively, where fluid velocity would otherwise be slowed significantly. This arrangement serves to minimize shell-side erosion problems.

Cones 135 serve to direct fluid flow towards tubesheet 180 and floating tubesheet 190 rather than permitting fluid to flow toward inlet nozzle 110 or outlet nozzle 120 as applicable. By doing so, the low-velocity fluid zones which would otherwise exist in the vicinity of tubesheet 180 and floating tubesheet 190 are eliminated. The size and shape of cones 135 are selected based upon fluid modeling studies, but in most cases standard parts which are readily available may be selected for use as cones 135.

FIG. 3 also illustrates the disposition of conical tubesheet extensions similar to those of FIG. 1. Tubesheet 180 includes a conical shaped extension 142 which protrudes toward the interior of the heat exchanger cavity and away from header 125. In this case, the extension has the form of a complete cone. A similar conical extension 142 is also provided on movable tubesheet 190. In one embodiment of the invention, the complete diameter of tubesheet 180 or 190 forms the base for the conical protrusion extending from the surface of the tubesheet. Alternatively, only a portion of the diameter of the tubesheet forms the base for the conical protrusion. For example, according to this embodiment, the conical protrusion may be formed to have a base diameter of 10–15 cm. (4–6 inches) while the diameter of the tubesheet may be on the order of 30–60 cm. (12–24 inches). It is preferable for the center point of the conical protrusion to be the same as the center point of the tubesheet itself. In other words, the conical protrusion is preferably centered on the circular surface of the tubesheet. The sizing and detailed shape of the conical protrusions may, of course, vary from the examples provided above.

The tube bundle 160 is supported by tube supports 170. Tube supports 170 are preferably metal coil structures as disclosed co-pending patent application entitled "Heat Exchanger Flow Through Tube Supports" referred to above. By using these novel metal coil structures as tube supports 170, conventional baffles may be eliminated and higher fluid velocities may be employed.

FIG. 4 illustrates a four-pass heat exchanger 400 in which two pass partition plates are included within header 125 and a partition plate is also included within the floating return head at the other end of heat exchanger 400.

Heat exchanger 500 which is illustrated in FIG. 5 is a single-pass heat exchanger with a floating return head. This design provides additional flexibility in achieving high velocities on the tube-side and shell-side simultaneously. The flow configuration may be either fully cocurrent or fully countercurrent. Heat exchanger 500 preferably includes tube-side expansion joint 592 which allows for movement of the floating head.

Figure 6:
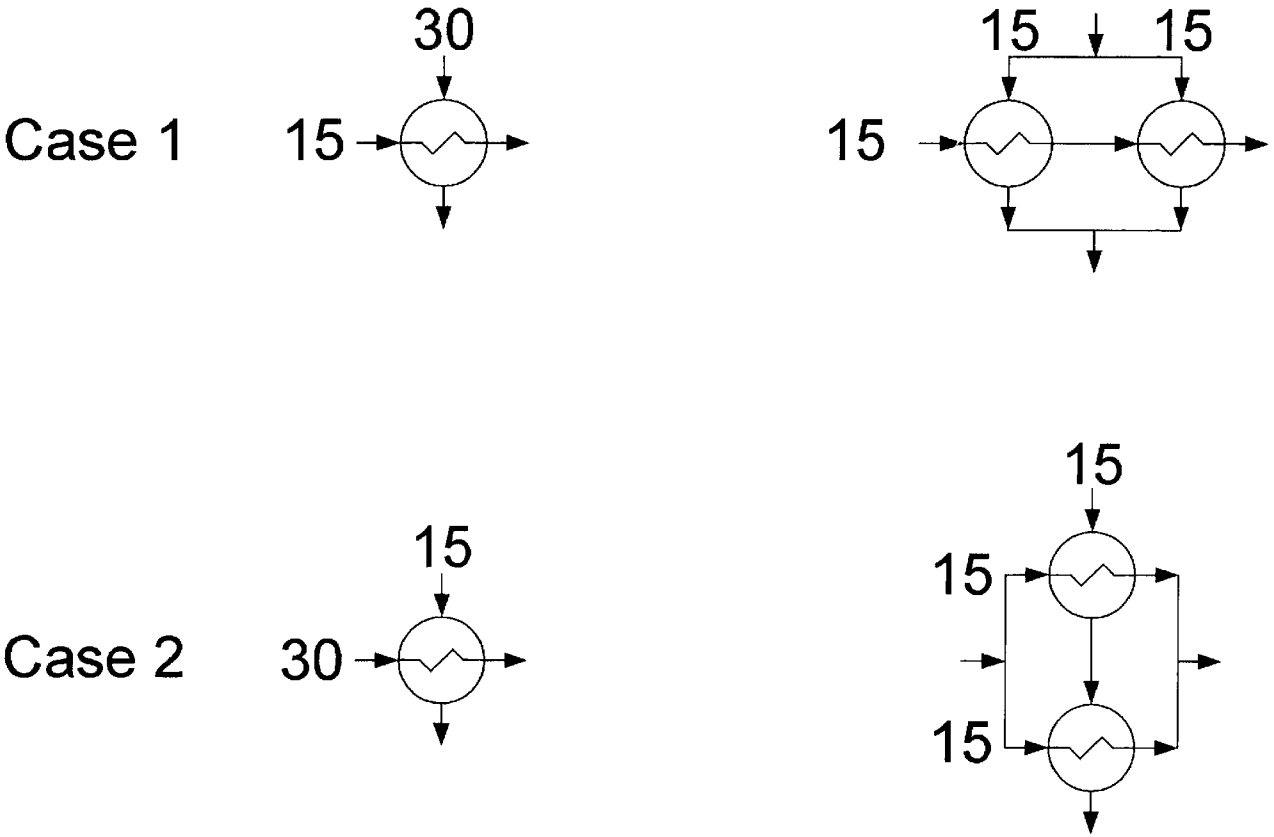
FIG. 6 is a diagram illustrating the use of modularity in connection with process flow design according to the teachings of the present invention.

FIG. 6 illustrates the modular approach that may be used in connection with the process engineering involving the use of the heat exchangers of the present invention. The heat exchangers of the present invention may be manufactured to provide several standard-size heat exchangers such that various combinations of the standard size heat exchangers may be used to obtain the desired overall heat transfer characteristics. For example, standard size heat exchanger units may be placed in parallel or series with respect to shell-side fluid or tube-side fluid or both in order to obtain the desired process flow and configuration.

Case 1 in FIG. 6 illustrates a conventional shell-and-tube heat exchanger that requires a fluid velocity of 4.6 $m.sec^{-1}$ (15 ft/second) for the tube-side fluid and 9.1 $m.sec^{-1}$ (30 ft/second) for the shell-side fluid. These fluid velocities are conventionally dictated by the volume flow rate and the cross-sectional flow areas available. Using the modular approach of the present invention, if a process design calls for 4.6 $m.sec^{-1}$ (15 ft/second) on both the shell-side and the tube-side, the standard size heat exchangers may be combined in series with respect to tube-side and in parallel with respect to shell-side in order to obtain the desired results and as shown on the right side of FIG. 6 for Case 1. Since shell-side fluid is passed through two equally sized heat exchangers, a shell-side fluid velocity which is originally 9.1 $m.sec^{-1}$ (30 ft/second) is stepped down to a 4.6 $m.sec^{-1}$ (15 ft/second) fluid velocity in each of two heat exchangers.

In Case 2 of the FIG. 6 illustration, when an original implementation results in a shell-side fluid velocity of 4.6 $m.sec^{-1}$ (15 ft/second) but a tube-side fluid velocity of 9.1 $m.sec^{-1}$ (30 ft/second), the heat exchangers may be placed in parallel with respect to the tube-side flow as is illustrated on the right side of FIG. 6 for Case 2 in order to obtain a 4.6 $m.sec^{-1}$ (15 ft/second) fluid velocity for both shell-side and tube-side fluids.

A strainer is preferably used at some point in the process line prior to reaching the heat exchanger. This is important in order to avoid any debris becoming trapped within the heat exchanger of the present invention either in a tube or on the shell-side of the heat exchanger. If debris of a large enough size or of a large enough amount were to enter the heat exchanger of the present invention (or, in fact, any currently existing heat exchanger) fluid velocities can be reduced to the point of rendering the heat exchanger ineffective.

What is claimed is:

1. A heat exchanger comprising:

(a) a shell;

(b) a header located at a first longitudinal end of the heat exchanger and comprising an inlet for introducing a fluid into the heat exchanger;

(c) a first, fixed tubesheet attached to the header and located at the first longitudinal end of the heat exchanger, (d) a tube bundle contained within the shell and further comprising a plurality of tubes for transferring the fluid;

(e) at least one girth ring;

(f) a second, movable tubesheet located at a second longitudinal end of the heat exchanger which is movable in the longitudinal direction in response to expansion and contraction of the tubes; and (g) at least one conical assembly connecting the shell to the at least one girth ring and extending from the outer surface of the shell to the at least one girth ring.

2. The heat exchanger of claim 1 in which each of the tube passes completely through one the aperture of a tubesheet and comprises a sacrificial section extending in a longitudinal direction away from the tubesheet and into the interior space of the channel.

3. The heat exchanger of claim 1 further comprising a central pipe which transfers tube-side fluid from the second longitudinal end of the heat exchanger to the first longitudinal end of the heat exchanger.

4. The heat exchanger of claim 3 in which the heat exchanger is a two-pass heat exchanger, a first pass transports a tube-side fluid from the first longitudinal end of the heat exchanger to the second longitudinal end of the heat exchanger, a second pass transports a tube-side fluid from the second longitudinal end of the heat exchanger through the central pipe to the first longitudinal end of the heat exchanger and in which substantially all of the heat transfer occurs within the heat exchanger during the first pass.

5. The heat exchanger of claim 1 in which the heat exchanger in which each tube comprises at least one sacrificial section extending in a longitudinal direction away from the first tubesheet and into the interior space of the header.

6. The heat exchanger of claim 1 in which fluid flow on the tube-side occurs in a countercurrent direction with respect to fluid flow on the shell-side of the heat exchanger.

7. The heat exchanger of claim 1 in which the tube bundle is removable from the shell through the use of at least one fastener connecting the first tubesheet to the girth ring at the first longitudinal end of the heat exchanger.

8. A heat exchanger comprising:

(a) a shell surrounding a tube bundle, the tube bundle comprising a plurality of tubes for transporting a tube-side fluid;

(b) a first inlet for introducing a shell-side fluid into the heat exchanger;

(c) a second inlet for introducing the tube-side fluid into the heat exchanger;

(d) at least two tubesheets, the tubesheets comprising apertures for accepting the tubes at least one of the tubesheets being movable in a longitudinal direction within the heat exchanger; and (e) at least one conical assembly extending from the outer surface of the shell to a girth ring located at a longitudinal end of the heat exchanger.

9. The heat exchanger of claim 8 comprising two conical assemblies in which the first conical assembly connects the shell to a girth ring fastened to the first tubesheet and the second conical assembly connects the shell to a girth ring located at the longitudinal end of the heat exchanger proximate the second tubesheet.

10. The heat exchanger of claim 8 in which at least one of the tubesheets further comprises a conical tubesheet extension, the conical tubesheet extension protruding in the direction toward the interior of the shell.

11. The heat exchanger of claim 8 further comprising a central pipe for transporting the tube-side fluid toward a tube-side fluid outlet.

12. The heat exchanger of claim 11 in which the central pipe further comprises an expansion section.

13. The heat exchanger of claim 8 in which the tube bundle is removable from the shell through the use of at least one fastener connecting the first tubesheet to the girth ring.

14. The heat exchanger of claim 9 in which the second, moveable tubesheet is located at least partly within the surrounding girth ring for movement within the girth ring located at the longitudinal end of the heat exchanger proximate the second tubesheet.

15. A heat exchanger comprising:

(a) a tube bundle further comprising a plurality of tubes for transporting a first fluid;

(b) a first tubesheet, the first tubesheet comprising a plurality of apertures for receiving first ends of the plurality of tubes;

(c) a second tubesheet, the second tubesheet comprising a plurality of apertures for receiving second ends of the plurality of tubes, the second tubesheet being movable in a longitudinal direction in response to expansion or contraction of the tubes in the tube bundle;

(d) a shell for transporting a second fluid, the tube bundle being contained within the shell;

(e) a first cone, the first cone connecting the shell to a girth ring located proximate the first tubesheet, the shell extends beyond the point at which the first cone contacts the shell in the direction towards the girth ring to form a shell extension within the first cone; and (f) a second cone, the second cone connecting the shell to a second girth ring located proximate the second tubesheet.

16. The heat exchanger of claim 14 in which the shell extends beyond the point at which the second cone contacts the shell in the direction of the second girth ring to form a second shell extension within the second cone.

17. The heat exchanger of claim 14 in which each the tube passes completely through the first tubesheet and comprises a sacrificial section extending in a longitudinal direction away from the first tubesheet and away from the shell.

18. The heat exchanger of claim 14 in which the first tubesheet includes a first conical tubesheet extension which protrudes in the direction toward the interior of the shell.

19. The heat exchanger of claim 14 in which the second tubesheet includes a second conical tubesheet extension which protrudes in the direction toward the interior of the shell.

20. The heat exchanger of claim 14 in which the second, moveable tubesheet is located at least partly within the second girth ring for longitudinal movement within the second girth ring.

* * * * *